US005144776A

United States Patent [19]

Hetzel et al.

[11] Patent Number: 5,144,776

[45] Date of Patent: Sep. 8, 1992

[54] HEADER ASSEMBLY

[75] Inventors: Joseph R. Hetzel, Macedonia; Kenneth L. Virgins, Hudson, both of Ohio

[73] Assignee: Patio Enclosures, Inc., Macedonia, Ohio

[21] Appl. No.: 641,123

[22] Filed: Jan. 14, 1991

[51] Int. Cl.[5] ..... E04B 7/06

[52] U.S. Cl. ..... 52/92; 52/403; 52/645

[58] Field of Search ..... 52/90, 91, 92, 644, 52/645, 646, 403

[56] References Cited

U.S. PATENT DOCUMENTS

| | | | |
|---|---|---|---|
| 3,411,254 | 11/1968 | Kessler | 52/403 X |
| 3,436,881 | 4/1969 | Schlecht | 52/90 |
| 3,771,277 | 11/1973 | Rausch et al. | 52/90 X |
| 4,185,439 | 1/1980 | Bischlipp et al. | 52/403 X |
| 4,314,424 | 2/1982 | Gordon et al. | 52/403 X |
| 4,330,919 | 5/1982 | Bischlipp et al. | 52/403 X |
| 4,614,067 | 9/1986 | Matsubara | 52/403 X |
| 4,872,297 | 10/1989 | Hetzel et al. | 52/92 |

*Primary Examiner*—David A. Scherbel
*Assistant Examiner*—Kien Nguyen
*Attorney, Agent, or Firm*—James A. Hudak

[57] ABSTRACT

Apparatus for adjustably attaching roof panels to the sidewalls of an enclosure and for securing the pitch of the roof panel with respect to the sidewalls after it has been established is disclosed. The apparatus includes a header support member which is placed on top of the sidewall and has a longitudinally extending pocket therein. A header arm having a longitudinally extending yoke at one end thereof is received in the longitudinally extending pocket in the header support member. After the roof pitch has been established by rotating the yoke portion of the header arm within the pocket in the header support member, the header arm is fastened to the header support member to secure the roof pitch. The header support member and the header arm each have a pocket formed therein which is filled with insulating material providing a thermal break within each of these components.

12 Claims, 2 Drawing Sheets

HEADER ASSEMBLY

TECHNICAL FIELD

The present invention relates, in general, to a header assembly for attaching roof panels to the side walls of an enclosure, such as a patio enclosure or the like, and, more particularly, to a header assembly which permits adjustment of the pitch of the roof panels with respect to the side walls and the securing of the pitch of the roof panels after it has been established, and which also includes insulating material within the components comprising the assembly.

BACKGROUND ART

Numerous apparatus are available for attaching roof panels to the side walls of an enclosure, such as a patio enclosure. Typically, such apparatus are relatively complex because they include a number of cooperating components Because of the number of components involved, such apparatus are relatively expensive to produce and time consuming to install on the side walls and roof panels to be joined. In addition, these apparatus usually do not include means for securing the pitch of the roof after it has been established, i.e., the apparatus relies solely on the support member, such as a hanger bracket, on the opposite end of the roof panels to maintain the roof pitch Furthermore, these apparatus typically do not incorporate insulating material to minimize the transmission of heat or cold through the apparatus thus improving the insulating value of the apparatus.

Because of the foregoing, it has become desirable to develop a header assembly which permits adjustment of the pitch of the roof and the securing of same with respect to the side walls of an enclosure and includes means which incorporates insulating material within the components comprising the header assembly.

SUMMARY OF THE INVENTION

The present invention solves the problems associated with the prior art and other problems by providing a relatively simple apparatus for adjustably attaching roof panels to the side walls of an enclosure and for securing the pitch of the roof with respect to the side walls after it has been established. The apparatus includes a longitudinally extending header support member which is placed on the top of the side wall and which includes a longitudinally extending pocket which is spaced apart from the top of the side wall. The header support member is comprised of a base portion and a top portion joined at their approximate midpoints and a curved portion which connects the top portion and the base portion and which is positioned so as to be oppositely disposed to the longitudinally extending pocket. A longitudinally extending pocket is provided at the junction of the base portion and the top portion and is filled with insulating material, thus minimizing the transmission of heat or cold through this member. A longitudinally extending header arm is provided and has a longitudinally extending yoke at one end thereof and a curved portion adjacent the other end thereof. The header arm includes a longitudinally extending pocket at its approximate mid-point which is filled with insulating material thus minimizing the transmission of heat or cold through this member. The longitudinally extending yoke in the header arm is slidingly received within the longitudinally extending pocket in the header support member and is positioned therein so that the curved portion of the header arm is on the exterior of the curved portion of the header support member The header arm is then attached to the underside of the roof panel to be supported. After attachment, the pitch in the roof panel can be adjusted by rotating the yoke on the header arm within the pocket in the header support member. After the roof pitch has been established, fasteners are placed in a spaced-apart relationship along the longitudinal axis of the header support member and the header arm and pass through their respective curved portions so as to secure the pitch of the roof.

DESCRIPTION OF THE PREFERRED EMBODIMENT

Figure 1:
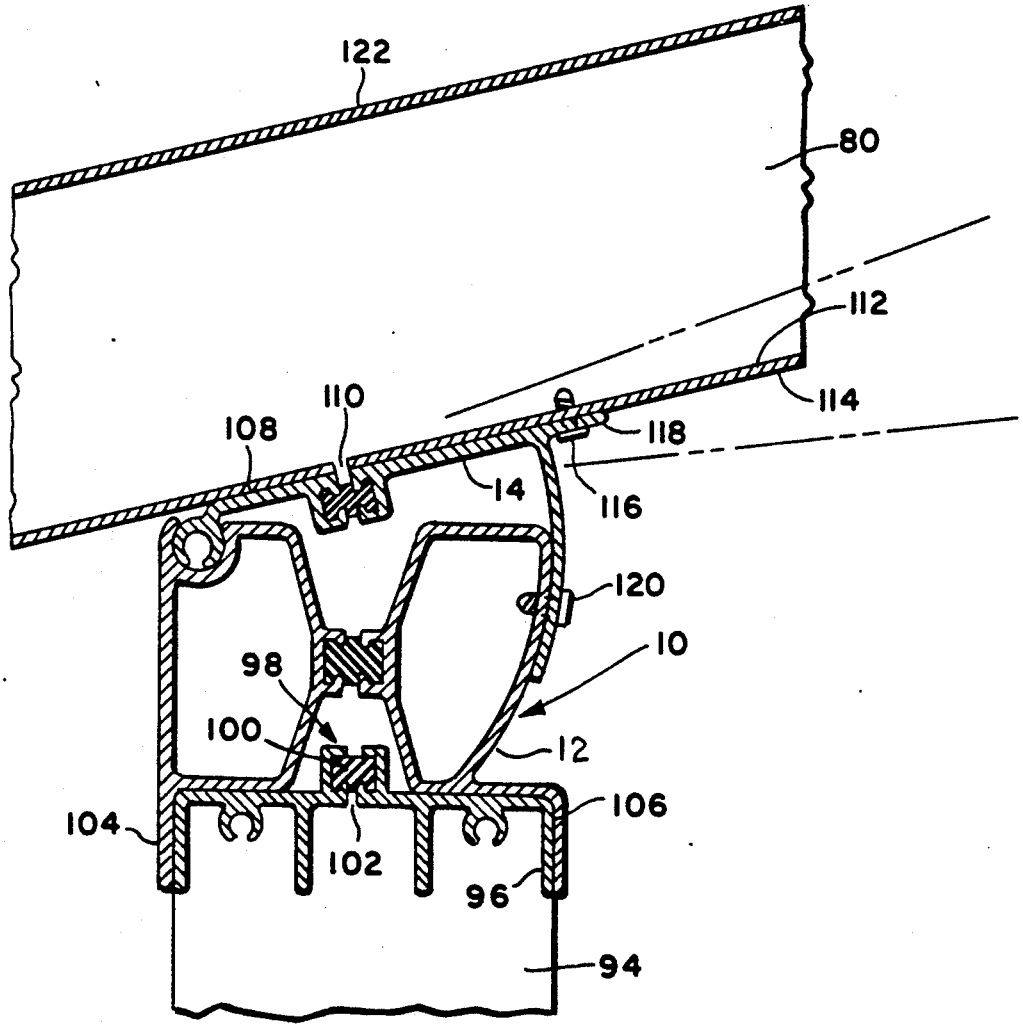
FIG. 1 is a cross-sectional view of the header assembly of the present invention and illustrates the adjustability of the pitch of the roof panel with respect to the side wall of an enclosure and the inclusion of insulating material which acts as a thermal break in the components comprising the header assembly.

Referring now to the drawings where the illustrations are for the purpose of describing the preferred embodiment of the present invention and are not intended to limit the invention described herein, FIG. 1 is a cross-sectional view of the header system 10 of the present invention. The header system 10 includes a longitudinally extending header support member 12 and a longitudinally extending header arm 14 which is pivotally attached thereto.

Figure 2:
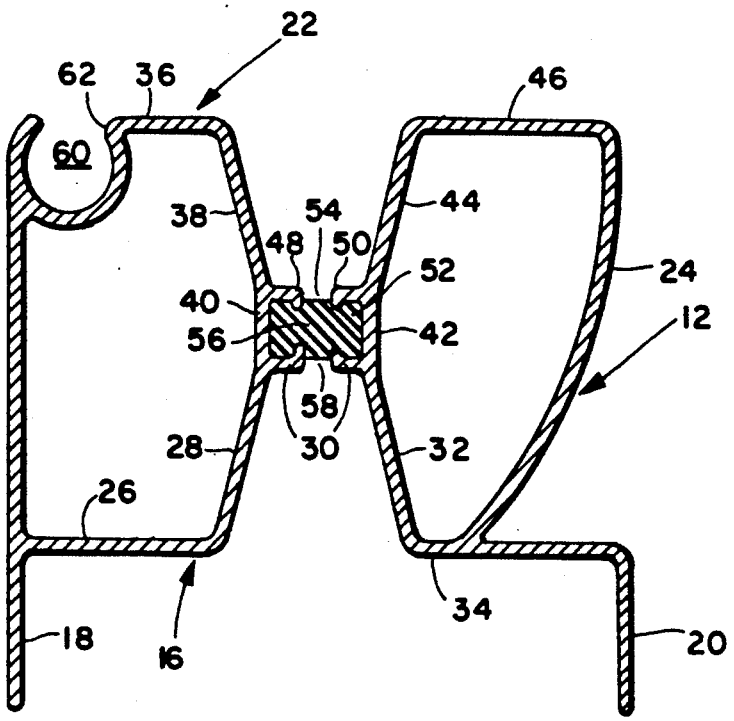
FIG. 2 is a cross-sectional view of the header support member of the present invention and illustrates the insulating material which acts as a thermal break within this component.

Referring now to FIG. 2, a cross-sectional view of the header support member 12 is illustrated. The header support member 12 is typically formed as a longitudinally extending extrusion, such as an aluminum extrusion, and includes a base portion, shown generally by the numeral 16, a first upright portion 18 which is connected to one end of the base portion 16, and a second upright portion 20 which is connected to the other end of the base portion 16, a top portion, shown generally by the numeral 22, and a curved portion 24 which interconnects the top portion 22 with the base portion 16. The second upright portion 20 terminates in the base portion 16 and is substantially parallel to the first upright portion 18.

The base portion 16 is comprised of a first portion 26, a second portion 28, a third portion 30, a fourth portion 32, and a fifth portion 34, all substantially straight in configuration. First base portion 26 and fifth base portion 34 are co-planar and are substantially perpendicular to first upright portion 18 and second upright portion 20. Third base portion 30 is substantially parallel to first base portion 26 and fifth base portion 34 Second base portion 28 interconnects one end of first base portion 26 to one end of third base portion 30. The other end of first base portion 26 is connected to first upright portion 18. Fourth base portion 32 interconnects the other end of third base portion 30 to one end of fifth base portion 34. The other end of fifth base portion 34 is connected to the second upright portion 20.

The top portion 22 is comprised of a first portion 36, a second portion 38, a third portion 40, a fourth portion 42, a fifth portion 44, and a sixth portion 46, all substantially straight in configuration. First top portion 36 and sixth top portion 46 are co-planar and are substantially parallel to first base portion 26 and fifth base portion 34. Third top portion 40 and fourth top portion 42 are substantially perpendicular to first top portion 36 and sixth top portion 46 and are substantially parallel to first upright portion 18 and second upright portion 20 of header support member 12. Second top portion 38 interconnects one end of first top portion 36 to one end of third top portion 40. The other end of third top portion 40 is connected to the junction of second base portion 28 and third base portion 30. Fifth top portion 44 interconnects one end of fourth top portion 42 to one end of sixth top portion 46 The other end of fourth top portion 42 is connected to the junction of third base portion 30 and fourth base portion 32. Inwardly directed lips 48 and 50 are attached respectively to the junction of second top portion 38 and third top portion 40 and to the junction of fourth top portion 42 and fifth top portion 44. Lips 48, 50 in conjunction with third top portion 40, fourth top portion 42 and third base portion 30 form a longitudinally extending pocket 52 which is positioned at the approximate mid-point of base portion 16 and top portion 22 and which has a longitudinally extending opening 54 thereto defined by lips 40 and 50. Longitudinally extending pocket 52 is filled with an insulating material 56, such as butyl rubber, which is allowed to cure. After curing has occurred, a longitudinally extending slit 58 is milled in third base portion 30. The longitudinally extending slit 58 and opening 54 act as a thermal break between second portion 28 and fourth portion 32 of base portion 16 and between second portion 38 and fifth portion 44 of top portion 22, respectively.

A longitudinally extending pocket 60 is positioned adjacent the junction of the first upright portion 18 and first top portion 36. The longitudinally extending pocket 60 has a substantially circular cross-section and a longitudinally extending opening 62 along its top surface. The transverse width of the opening 62 is greater than the radius of the surface forming the pocket 60. The thickness of the webs forming the base portion 16, the first upright portion 18, the second upright portion 20, the top portion 22, the curved portion 24, and the pocket 60 are substantially the same. It should be noted that the transverse distance between the first upright portion 18 and the second upright portion 20 is approximately the same as the thickness of the structure on which the header support member 12 is to be placed.

Figure 3:
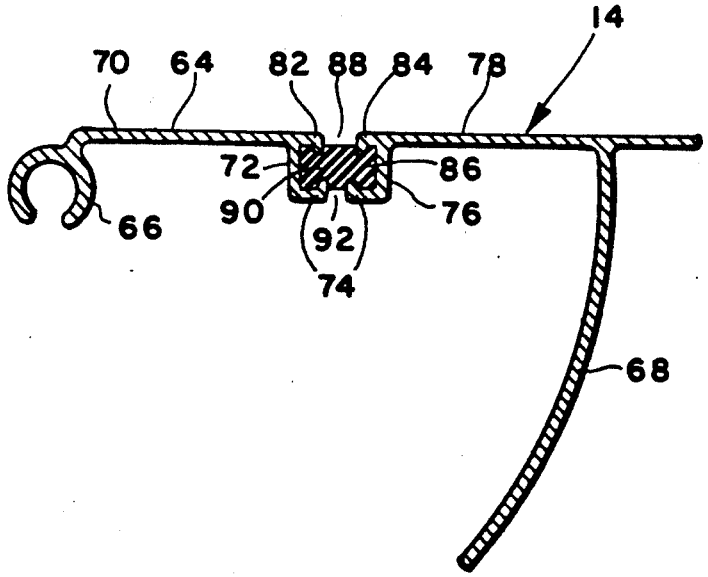
FIG. 3 is a cross-sectional view of the header arm of the present invention and illustrates the insulating material which acts as a thermal break within this component.

Referring now to FIG. 3, a cross-sectional view of the header arm 14 is illustrated. The header arm 14 is typically formed as an extrusion, such as an aluminum extrusion, and is comprised of an arm portion 64 having a longitudinally extending yoke 66 attached to one end thereof and a curved portion 68 adjacent the opposite end thereof. The arm portion 64 is comprised of a first portion 70, a second portion 72, a third portion 74, a fourth portion 76 and a fifth portion 78. First arm portion 70 and fifth arm portion 78 are substantially co-planar and substantially parallel to third arm portion 74. One end of first arm portion 70 is connected to yoke 66, and one end of fifth arm portion 78 is connected to curved portion 68. Fifth arm portion 78 extends beyond its junction with curved portion 68 to allow for the connection of header arm 14 to structure 80, as shown in FIG. 1. Second arm portion 72 connects the other end of first arm portion 70 to one end of third arm portion 74. Fourth arm portion 76 connects the other end of fifth arm portion 78 to the other end of third arm portion 74. Second arm portion 72 and fourth arm portion 76 are substantially perpendicular to first arm portion 70 and fifth arm portion 78. Inwardly directed lips 82 and 84 are attached to the junction of first arm portion 70 and second arm portion 72 and to the junction of fourth arm portion 76 and fifth arm portion 78, respectively Lips 82, 84 in conjunction with second arm portion 72, third arm portion 74 and fourth arm portion 76 form a longitudinally extending pocket 86 which is positioned at the approximate mid-point of the arm portion 64 and which has a longitudinally extending opening 88 thereto defined by lips 82 and 84 The longitudinally extending pocket 86 is filled with insulating material 90, such as butyl rubber, which is allowed to cure. After curing has occurred, a longitudinally extending slit 92 is milled in third arm portion 74 The opening 88 and the longitudinally extending slit 92 act as a thermal break between first arm portion 70 and fifth arm portion 78 and between second arm portion 72 and fourth arm portion 76, respectively.

The outer diameter of the yoke 66 on the header arm 14 is slightly smaller than the inner diameter of the pocket 60 in the header support member 12. The yoke 66 is offset from the arm portion 64 of the header arm 14 by an obtuse angle formed therebetween. The radius of curvature of the curved portion 68 of the header arm 14 with respect to the center of the yoke 66 is approximately the same as the radius of curvature of the curved portion 24 of the header support member 12 with respect to the center of the pocket 60 therein. The radial distance between the longitudinally extending yoke 66 and the curved portion 68 of the header arm 14 is such that the curved portion 68 of the arm 14 is on the outside of the curved portion 24 of the header support member 12 when the yoke 66 on the header arm 14 is received within the pocket 60 in the header support member 12. The thickness of the webs forming the arm portion 64, the yoke 66 and the curved portion 68 of the header arm 14 are substantially the same, and approximate the thickness of the aforementioned webs comprising the header support member 12.

In order to assemble the header system 10, the longitudinally extending yoke 66 on the header arm 14 is slidingly received within the longitudinally extending pocket 60 in the header support member 12. The header support member 12 is then placed on the top surface of a structure 94, such as a side wall, which is to be attached to structure 80, such as a roof panel. The top surface of the structure 94 is provided with a frame member, shown generally by the numeral 96, provided thereon Frame member 96 includes a thermal break portion, shown generally by the numeral 98, similar to the aforementioned thermal breaks in header support member 12 and the header arm 14. Thermal break 98 is filled with insulating material 100, such as butyl rubber, which is allowed to cure. After curing has occurred, a slit 102 is milled in the frame member 96 forming the thermal break. When the header support member 12 is placed on the top surface of the structure 94, the first upright portion 18 and the second upright portion 20 of the header support member 12 engage the front surface 104 and the rear surface 106, respectively, of the frame member 96. After placement of the header support member 12 on the top surface of the structure 94, the first base portion 26 and the fifth base portion 34 are attached to the top surface of the structure 94 by various fastening techniques. Alternatively, the first and second upright portions 18 and 20 of the header support member 12 can be attached to the front surface 104 and the rear surface 106, respectively, of the frame member 96. The top surface 108 of the header arm 14 is then attached aligned with the roof panel 80 so that a longitudinally extending slit 110 in the inner metallic face 112 of the roof panel 80 is opposite longitudinally extending opening 88 in header arm 14. After alignment has been achieved, the header arm 14 is attached to the bottom surface 114 of the roof panel 80 by means of fasteners 116, such as sheet metal screws, which are positioned in a spaced-apart relationship along the longitudinal axis of the bottom 118 of the header arm 14. After attachment, the pitch of the roof panel 80 can be adjusted by rotating the yoke 66 of the header arm 14 within the pocket 60 in the header support member 12 to establish the desired roof pitch. After the proper roof pitch has been established, fasteners 120, such as sheet metal screws, are placed in a spaced-apart relationship along the longitudinal axis of the header support member 12 and the header arm 14 so as to pass through their respective curved portions 24 and 68. In this manner, the pitch of the roof is secured after it has been established. The insulating material 56 and 90 within pockets 52 and 86, in the header support member 12 and header arm 14, respectively, acts as a thermal break minimizing the transmission of heat or cold through the roof structure, header assembly and side walls to the interior surfaces connected thereto In this manner, the resulting insulating value of the header assembly is improved. It should be noted that structures 94 and 80 also contain insulating material which acts as a thermal break between the front surface 104 and the rear surface 106 of the frame member 96 and between the top surface 122 and bottom surface 114 of structure 80, respectively.

The opening 62 in the header support member 12 is of sufficient width to permit the yoke 66 on the header arm 14 to rotate through a relatively wide arc with respect to the base portion 16 in the header support member 12, thus permitting substantial adjustment of the pitch of the roof panel 80 with respect to the structure 94. In addition, the height of the first upright portion 18 and the curved portion 24 above the base portion 16 of the header support member 12 are sufficient to allow rotation of the header arm 14 through a relatively wide arc with respect to the header support member 12 and the securing of the curved portions 24 and 68 after the roof pitch has been established The length of curved portion 68 of the header arm 14 can be increased to allow for situations that require a steeper roof pitch.

Certain modifications and improvements will occur to those skilled in the art upon reading the foregoing. It should be noted that all such modifications and improvements have been deleted herein for the sake of conciseness and readability, but are properly within the scope of the following claims.

We claim:

1. Apparatus for attaching a roof panel to a side wall of an enclosure comprising a first elongated member having a base portion, a top portion, a first upright portion joining one end of said top portion to one end of said base portion, and an arcuate portion oppositely disposed to said first upright portion and joining the other end of said top portion to said base portion, said base portion having a configuration that conforms to the top of the side wall permitting the top of the side wall to be received therein for attachment thereto, said first upright portion and said top portion having a first longitudinally extending pocket formed at the approximate junction thereof, said top portion and said base portion being joined at their respective approximate mid-points forming a second longitudinally extending pocket, said second longitudinally extending pocket being defined by a first pair of longitudinally extending surfaces connected to said top portion each of said longitudinal extending surfaces having an inner end a second pair of longitudinally extending surfaces connected to said base portion, and a third pair of longitudinally extending surfaces which interconnect said first pair of longitudinally extending surfaces with said second pair of longitudinally extending surfaces said inner ends of said first pair of longitudinally extending surfaces and said second pair of longitudinally extending surfaces having inwardly directed longitudinally extending projections formed thereon, insulating material received with said second longitudinally extending pocket forming a thermal break in said first elongated member, said inwardly directed longitudinally extending projections on said first pair of longitudinally extending surfaces and said second pair of longitudinally extending surfaces grippingly engaging said insulating material, and a second elongated member for attachment to the roof panel, said second elongated member having a longitudinally extending yoke portion formed therein, said longtidunally extending yoke portion of said second elongated member being slidably receivable and rotatable within said first longitudinally extending pocket in said first elongated member.

2. The apparatus as defined in claim 1 wherein said first longitudinally extending pocket in said first elongated member is formed by a longitudinally extending slit, said slit being of sufficient transverse width to permit said second elongated member to rotate through a substantial arc with respect to said first elongated member.

3. The apparatus as defined in claim 1 wherein said second elongated member includes an arm portion having an axis which is angularly offset from the axis of said longitudinally extending yoke portion.

4. The apparatus as defined in claim 1 wherein said second elongated member includes an arcuate portion oppositely disposed to said yoke portion and having a configuration which conforms to said arcuate portion of said first elongated member permitting the receipt of fastening means through said arcuate portions securing the pitch of the roof after it has been established.

5. Apparatus for attaching a roof panel to a side wall of an enclosure comprising a first elongated member having a base portion, a top portion, a first upright portion joining one end of said top portion to one end of said base portion, and an arcuate portion oppositely disposed to said first upright portion and joining the other end of said top portion to said base portion, said base portion having a configuration that conforms to the top of the side wall permitting the top of the side wall to be received therein for attachment thereto, said first upright portion and said top portion having a longitudinally extending pocket formed at the approximate junction thereof, and a second elongated member for attachment to the roof panel, said second elongated member having a longitudinally extending pocket and a longitudinally extending yoke portion formed therein, said longitudinally extending pocket within said second elongated member being defined by a first pair of longitudinally extending surfaces, each of said longitudinal extending surfaces having an inner end, a second pair of longitudinally extending surfaces, and a third pair of longitudinally extending surfaces which interconnect said first pair of longitudinally extending surfaces with said second pair of longitudinally extending surfaces, said inner ends of said first pair of longitudinally extending surfaces and said second pair of longitudinally extending surfaces having inwardly directed longitudinally extending projections formed thereon, insulating material received within said longitudinally extending pocket in said second elongated member forming a thermal break in said second elongated member, said inwardly directed longitudinally extending projections on said first pair of longitudinally extending surfaces and said second pair of longitudinally extending surfaces grippingly engaging said insulating material, said longitudinally extending yoke portion of said second elongated member being slidingly receivable and rotatable within said longitudinally extending pocket in said first elongated member.

6. The apparatus as defined in claim 5 wherein said longitudinally extending pocket in said first elongated member is formed by a longitudinally extending slit, said slit being of sufficient transverse width to permit said second elongated member to rotate through a substantial arc with respect to said first elongated member.

7. The apparatus as defined in claim 5 wherein said second elongated member includes an arm portion having an axis which is angularly offset from the axis of said longitudinally extending yoke portion.

8. The apparatus as defined in claim 5 wherein said second elongated member includes an arcuate portion oppositely disposed to said yoke portion and having a configuration which conforms to said arcuate portion of said first elongated member permitting the receipt of fastening means through said arcuate portions securing the pitch of the roof after it has been established.

9. Apparatus for attaching a roof panel to a side wall of an enclosure comprising a first elongated member having a base portion, a top portion, a first upright portion joining one end of said top portion to one end of said base portion, and an arcuate portion oppositely disposed to said first upright portion and joining the other end of said top portion to said base portion, said base portion having a configuration that conforms to the top of the side wall permitting the top of the side wall to be received therein for attachment thereto, said first upright portion and said top portion having a first longitudinally extending pocket formed at the approximate junction thereof, said top portion and said base portion being joined at their respective approximate mid-points forming a second longitudinally extending pocket, said second longitudinally extending pocket being defined by a first pair of longitudinally extending surfaces connected to said top portion, each of said longitudinal extending surfaces having an inner end, a second pair of longitudinally extending surfaces connected to said base portion, and a third pair of longitudinally extending surfaces which interconnect said first pair of longitudinally extending surfaces with said second pair of longitudinally extending surfaces, said inner ends of said first pair of longitudinally extending surfaces and said second pair of longitudinally extending surfaces having inwardly directed longitudinally extending projections formed thereon, first insulating material received within said second longitudinally extending pocket forming a thermal break in said first elongated member, said inwardly directed longitudinally extending projections on said first pair of longitudinally extending surfaces and said second pair of longitudinally extending surfaces grippingly engaging said first insulating material, and a second elongated member for attachment to the roof panel, said second elongated member having a longitudinally extending pocket and a longitudinally extending yoke portion formed therein, said longitudinally extending pocket within said second elongated member being defined by a first pair of longitudinally extending surfaces, a second pair of longitudinally extending surfaces, and a third pair of longitudinally extending surfaces which interconnected said first pair of longitudinally extending surfaces with said second pair of longitudinally extending surfaces, the inner ends of said first pair of longitudinally extending surfaces and said second pair of longitudinally extending surfaces having inwardly directed longitudinally extending projections formed thereon, second insulating material received within said longitudinally extending pocket in said second elongated member forming a thermal break in said second elongated member, said inwardly directed longitudinally extending projections on said first pair of longitudinally extending surfaces and said second pair of longitudinally extending surfaces grippingly engaging said second insulating material, said longitudinally extending yoke portion of said second elongated member being slidably receivable and rotatable within said first longitudinally extending pocket in said first elongated member.

10. The apparatus as defined in claim 9 wherein said first longitudinally extending pocket in said first elongated member is formed by a longitudinally extending slit, said slit being of sufficient transverse width to permit said second elongated member to rotate through a substantial arc with respect to said first elongated member.

11. The apparatus as defined in claim 9 wherein said second elongated member includes an arm portion having an axis which is angularly offset from the axis of said longitudinally extending yoke portion.

12. The apparatus as defined in claim 9 wherein said second elongated member includes an arcuate portion oppositely disposed to said yoke portion and having a configuration which conforms to said arcuate portion of said first elongated member permitting the receipt of fastening means through said arcuate portions securing the pitch of the roof after it has been established.

* * * * *